US009484680B2

(12) United States Patent
Davuluri et al.

(10) Patent No.: US 9,484,680 B2
(45) Date of Patent: Nov. 1, 2016

(54) RADIO FREQUENCY INTERFERENCE SHIELD

(71) Applicant: Intel Corporation, Santa Clara, CA (US)

(72) Inventors: Pujitha Davuluri, Hillsboro, OR (US); Chung-Hao J. Chen, Portland, OR (US); Kuan-Yu Chen, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 184 days.

(21) Appl. No.: 13/915,872

(22) Filed: Jun. 12, 2013

(65) Prior Publication Data

US 2014/0370750 A1 Dec. 18, 2014

(51) Int. Cl.

| | |
|---|---|
| ***H01R 13/659*** | (2011.01) |
| ***H01R 13/6597*** | (2011.01) |
| ***H01R 13/6582*** | (2011.01) |
| ***H01R 13/6594*** | (2011.01) |

(52) U.S. Cl.

CPC ..... *H01R 13/6597* (2013.01); *H01R 13/6582* (2013.01); *H01R 13/6594* (2013.01)

(58) Field of Classification Search

CPC ..... H01R 13/6582; H01R 13/6594; H01R 13/6597

See application file for complete search history.

(56) References Cited

U.S. PATENT DOCUMENTS

| | | | | |
|---|---|---|---|---|
| 4,663,240 | A * | 5/1987 | Hajdu | H05K 9/0083 174/377 |
| 6,000,968 | A * | 12/1999 | Hagiwara | 439/607.01 |
| 6,036,545 | A * | 3/2000 | Caviness et al. | 439/620.1 |
| 6,183,307 | B1 * | 2/2001 | Laity | H01R 31/06 361/679.4 |
| 7,175,465 | B1 * | 2/2007 | Tsai | H01R 13/6275 439/352 |
| 7,211,739 | B1 * | 5/2007 | Brigham, Jr. | H05K 9/0058 174/359 |
| 7,467,977 | B1 * | 12/2008 | Yi et al. | 439/607.01 |
| 7,632,145 | B1 | 12/2009 | Lin et al. | |
| 7,758,382 | B2 * | 7/2010 | Hiratsuka | H01R 13/6485 439/607.34 |
| 8,287,299 | B2 * | 10/2012 | Ray | H01R 13/6273 439/353 |
| 2003/0132022 | A1 * | 7/2003 | Williams | H01B 7/0823 174/113 R |
| 2009/0318026 | A1 * | 12/2009 | Yi et al. | 439/607.24 |
| 2010/0290743 | A1 | 11/2010 | Liao et al. | |
| 2011/0235293 | A1 | 9/2011 | Nagata et al. | |
| 2011/0237134 | A1 | 9/2011 | Gao et al. | |
| 2011/0306238 | A1 | 12/2011 | Yu et al. | |
| 2012/0021629 | A1 * | 1/2012 | Chen et al. | 439/188 |
| 2013/0288526 | A1 * | 10/2013 | Rascon | H01R 13/6581 439/607.35 |
| 2014/0199862 | A1 * | 7/2014 | Hirschy | H01R 12/585 439/84 |
| 2014/0370750 | A1 * | 12/2014 | Davuluri et al. | 439/607.34 |

FOREIGN PATENT DOCUMENTS

| | | | |
|---|---|---|---|
| EP | 0928049 | A2 | 7/1999 |
| EP | 2369686 | A1 | 9/2011 |

* cited by examiner

*Primary Examiner* — James Harvey

(74) *Attorney, Agent, or Firm* — International IP Law Group, P.L.L.C.

(57) ABSTRACT

An apparatus is described herein. The apparatus includes a receptacle to receive a plug to couple a peripheral device to a computing device. The apparatus includes a ground contact of a printed circuit board of the computing device. The apparatus includes a shield communicatively coupled to the ground contact, wherein the shield is to reduce radio frequency interference (RFI) from an interface between the plug and the receptacle.

18 Claims, 5 Drawing Sheets

100

100

200

300

104

102

RADIO FREQUENCY INTERFERENCE SHIELD

BACKGROUND ART

A computing device may include input/output (I/O) interfaces to enable a peripheral device to communicate with an information processing system, such as a processor, of the computing device. Each I/O interface may include a connector associated with a communications protocol such as a universal serial bus (USB) connector associated with a USB communication protocol. In some cases, the I/O interface may emit radio frequencies that interfere with operations of the computing device. The radio frequency interference (RFI) may cause signal degradation in components such as wireless transmitters, wireless receivers, wireless transceivers, and the like.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

The present disclosure relates generally to techniques for reducing radio frequency interference (RFI) at an input/output (I/O) interface. The I/O interface may include a physical interface between a computing device and a peripheral device. The physical interface includes a receptacle configured to receive a plug. The I/O interface may emit radio frequencies, such as radio frequency interference that can interfere with operations performed by a computing device. For example, RFI from the I/O interface may interfere with operations of a wireless receiving component of the computing device. In some embodiments, RFI is emitted at the I/O interface at least partially as a consequence to a lack of communicative coupling from the plug to the receptacle and from the receptacle to ground. To reduce RFI, the I/O interface may include shielding to reduce RFI including shielding generated near the back of the receptacle. The shielding may be connected to ground via a circuit board of the computing device.

Figure 1:
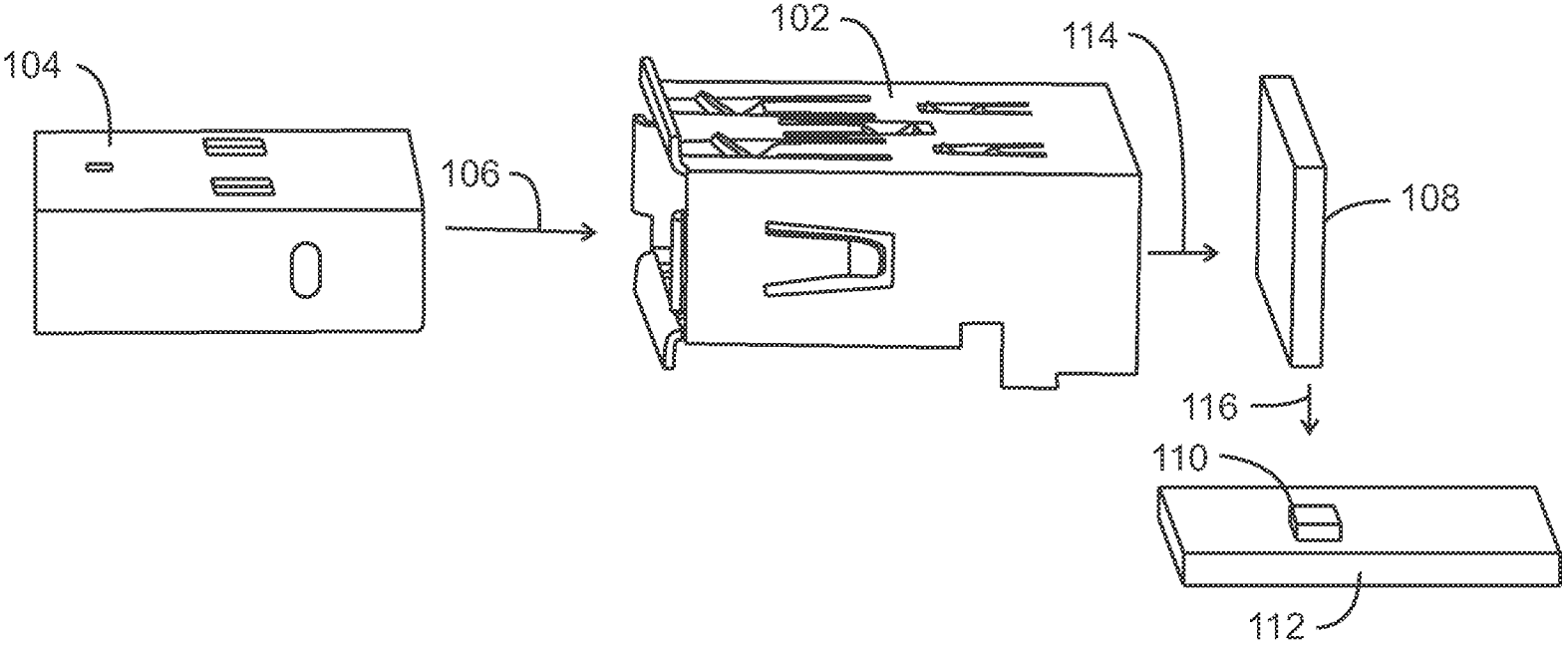
FIG. 1 is a diagram illustrating a peripheral view of an I/O interface having shielding to reduce radio frequency interference (RFI).

FIG. 1 is a diagram illustrating a peripheral view of an I/O interface having shielding to reduce RFI. The I/O interface includes a receptacle 102 and a plug 104. The receptacle 102 may be configured to receive the plug 104 as indicated by the arrow 106.

The I/O interface 100 may be configured to communicatively couple a computing device (not shown) to a peripheral device (not shown). The computing device may be, for example, a laptop computer, desktop computer, tablet computer, mobile device, server, or cellular phone, a wearable computing device, among others. In some embodiments, the peripheral device is a computing device as listed above. In some embodiments, the peripheral device is a peripheral hard disk drive, a media player, a camera, a thumb drive, a display, and the like.

In some embodiments, the I/O interface 100 may be a universal serial bus (USB) interface. In some embodiments, the I/O interface 100 may be other I/O interfaces including computer bus interfaces such as Display Port, digital visual interface (DVI), video graphics array (VGA), and the like. In some embodiments, the I/O interface 100 includes any future unified I/O implementations.

As discussed above, the I/O interface 100 may be configured to communicatively couple the computing device to a peripheral device. The receptacle 102 is configured to receive the plug 104 to couple the computing device to the peripheral device. The receptacle 102 may include a back shield 108 configured to reduce RFI that may be emitted from the I/O interface 100 to other components of the computing device. As discussed in more detail below in regard to FIG. 2, the back shield 108 may be configured to be coupled to a ground contact 110 of a circuit board 112, as illustrated by the arrows 114 and 116.

Figure 2:
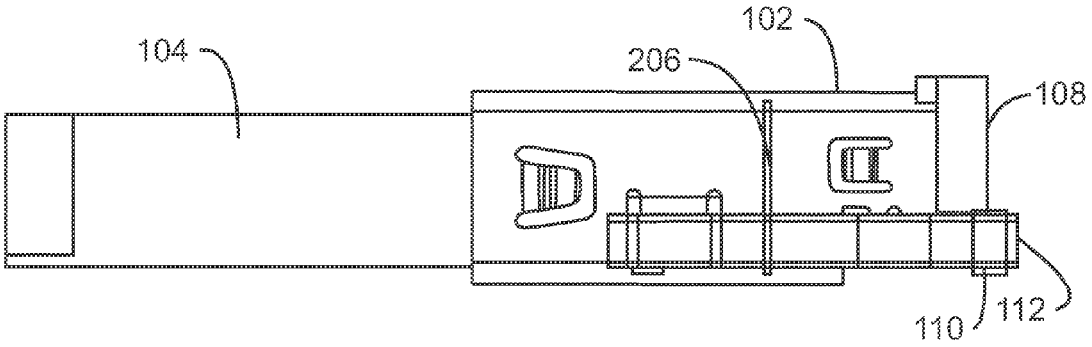
FIG. 2 is a diagram illustrating a side view of the I/O interface having a shield coupled to a ground contact.

FIG. 2 is a diagram illustrating a side view of the I/O interface having a shield coupled to a ground contact. As illustrated in FIG. 2, the back shield 108 may be coupled to the ground contact 110. As discussed above, the ground contact 110 may be a ground contact of the circuit board 112, such as a printed circuit board, of a computing device. The coupling of the back shield 108 to the ground contact 110 may reduce RFI emitted from the I/O interface. The back shield 108 may at least partially reduce the RFI emitted. In some embodiments, the reduction RFI at the back shield 108 may consequently reduce RFI received at other components of the computing device.

The back shield 108 may be disposed near the back of the receptacle 102. The back of the receptacle 102 may be a part of the receptacle 102 near a circuit board having a ground contact, such as the ground contact 110 of the printed circuit board 112. In some embodiments, an interface between the receptacle 102 and the plug 104 may include a side shield 206 configured to reduce RFI. The side shield 206 may be disposed at a perimeter of the interface between the plug 104 and the receptacle 102.

Figure 3:
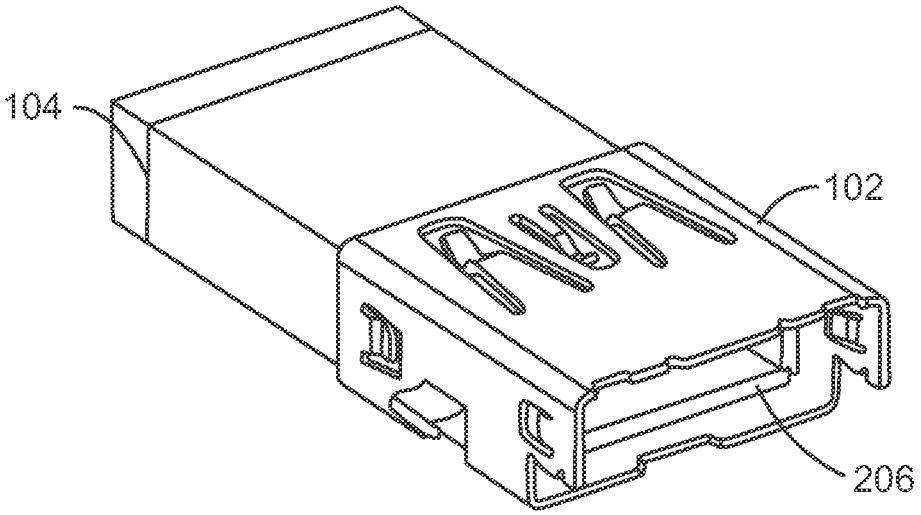
FIG. 3 is a diagram illustrating a peripheral view of the shield at the interface between the plug and the receptacle.

FIG. 3 is a diagram illustrating a peripheral view of the shield at the interface between the plug and the receptacle. The side shield 206 may be disposed at the interface of a side of the plug 104 and a side of the receptacle 102. As illustrated in FIG. 3, the side shield 206 may surround the periphery of the plug 104. The side shield 206 may communicatively couple the plug 104 to the receptacle 102, and thereby reduce RFI emitted from the I/O interface as the receptacle 102 is coupled to a ground contact, such as the ground contact 110 of FIG. 1 and FIG. 2.

Figure 4:
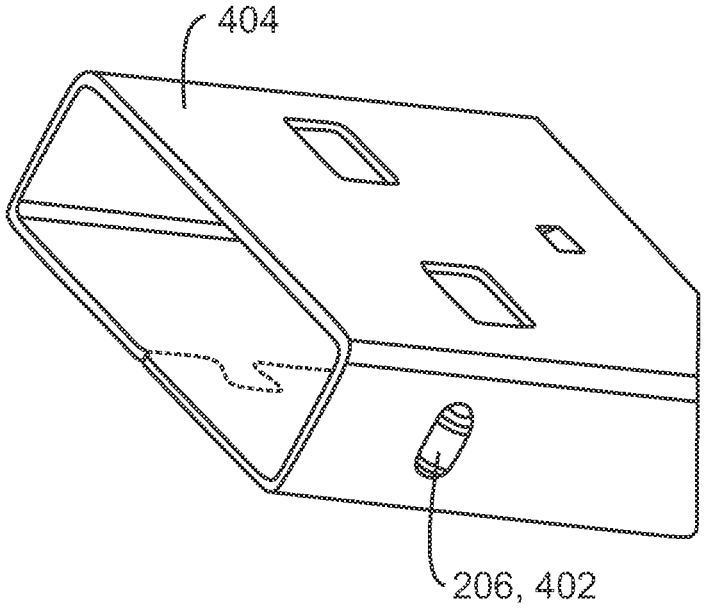
FIG. 4 is a diagram illustrating a peripheral view of a shield of an outer body of the plug.

FIG. 4 is a diagram illustrating a peripheral view of a shield of an outer body of the plug. The shield 402 may be one embodiment of the side shield 206 discussed above in reference to FIG. 3. As illustrated in FIG. 4, the shield 402 includes a protrusion of the outer body 404 of a plug, such as the plug 104 of FIG. 1. The shield 402 may communicatively couple the plug 104 to a receptacle, such as the receptacle 102 of FIG. 1. The protrusion of the shield 402 may enable the plug 104 to be communicatively coupled to the receptacle 102 thereby reducing RFI emitted from the I/O interface.

In some embodiments, the shield 402 may be disposed at a side of the I/O interface where emitted radiation is relatively higher. For example, the plug 104 may be a USB connector having higher RFI emitted from one side when compared to another side. In some embodiments, the shield 402 may be disposed at more than one side of the plug 104.

Figure 5:
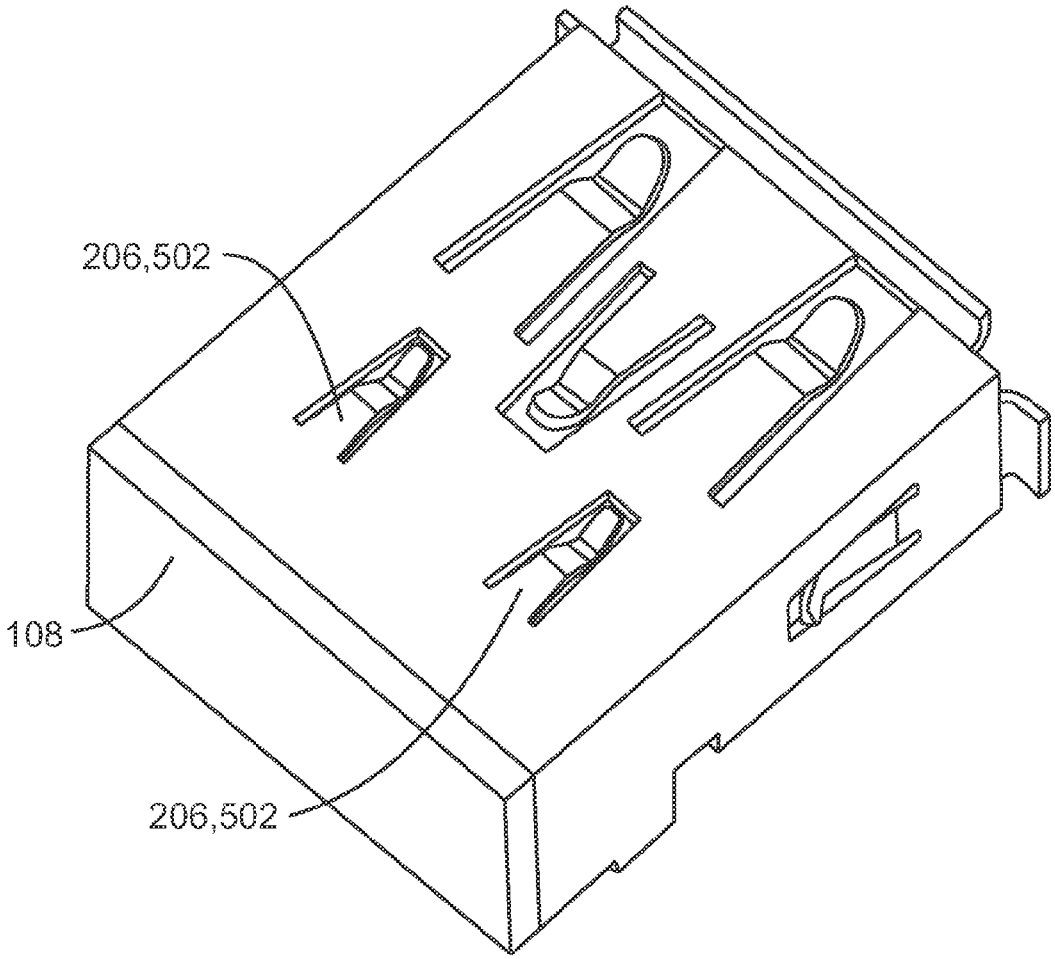
FIG. 5 is a diagram illustrating a peripheral view of a shield of the receptacle.

FIG. 5 is a diagram illustrating a peripheral view of a shield of the receptacle. The shield 502 may be one embodiment of the side shield 206 discussed above in reference to FIG. 3. As illustrated in FIG. 5, the shield 502 may be protrusions of the receptacle 102. The shield 502 may form a communicative coupling between the receptacle 102 and a plug, such as the plug 104 of FIG. 1. In some embodiments, the shield 502 may be latches configured to communicatively couple a plug 104 to the receptacle 102 when the plug 104 is received at the receptacle 102. In some embodiments, the shield 502 includes any other suitable type of protrusion enabling the plug 104 to be communicatively coupled to the receptacle 102. As illustrated in FIG. 5, the receptacle 102 may include the back shield 108, as well as the shield 502 of the receptacle.

In some embodiments, the shield 502 may be disposed at a side of the I/O interface where emitted radiation is relatively higher. For example, the receptacle 102 may be a USB connector having higher RFI emitted from one side when compared to another side. In some embodiments, the shield 502 is disposed at more than one side of the receptacle 102.

Example 1

An apparatus to couple a peripheral device to a computing device is described herein. The apparatus may include a receptacle. The receptacle may be configured to receive a plug to couple the peripheral device to the computing device. The apparatus includes a ground contact of a circuit board of the computing device. The apparatus includes a shield communicatively coupled to the ground contact, wherein the shield is disposed near the back of the receptacle and the shield is to reduce radio frequency interference (RFI) from an interface between the plug and the receptacle.

Example 2

An input/output (I/O) interface is described herein. The I/O interface may be configured to couple a peripheral device to a computing device. The I/O interface may include a receptacle of the I/O interface, wherein the receptacle is to receive a plug. The I/O interface may include a ground contact of a circuit board. The I/O interface may include a shield directly coupled to the ground contact, wherein the shield is to reduce radio frequency interference (RFI) from the I/O interface.

Example 3

An input/output (I/O) interface is described herein. The I/O interface may be configured to couple a peripheral device to a computing device. The I/O interface may include a receptacle, wherein the receptacle is to receive a plug. The I/O interface may include a ground contact of a circuit board. The I/O interface may include a shield directly coupled to the ground contact, wherein the shield is to reduce radio frequency interference (RFI) from the I/O interface.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein.

Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus to couple a peripheral device to a computing device, comprising;

a receptacle to receive a plug to couple the peripheral device to the computing device;

a ground contact of a circuit board of the computing device;

a back shield communicatively coupled to the ground contact, wherein the back shield is to reduce radio frequency interference (RFI) from an interface between the plug and the receptacle;

a side shield disposed as a continuous protrusion surrounding a periphery at the interface between the plug and the receptacle.

2. The apparatus of claim 1, wherein the side shield continuously spans at least a first edge of the receptacle to a second edge of the receptacle.

3. The apparatus of claim 2, wherein the side shield continuously spans at least the second edge of the receptacle to a third edge of the receptacle.

4. The apparatus of claim 1, wherein the side shield is configured to receive a protrusion of the plug to communicatively couple the plug to the receptacle.

5. The apparatus of claim 1, wherein the side shield is a protrusion of the receptacle to communicatively couple the plug to the receptacle.

6. The apparatus of claim 1, wherein the interface comprises a first side that radiates relatively more RFI than a second side of the interface, and wherein the side shield is disposed at the first side.

7. The apparatus of claim 1, wherein the back shield is communicatively coupled to the ground contact.

8. The apparatus of claim 1, wherein the back shield is communicatively coupled to the receptacle.

9. An input/output (I/O) interface to couple a peripheral device to a computing device, comprising:

a receptacle of the I/O interface, wherein the receptacle is configured to receive a plug;

a ground contact of a circuit board;

a back shield communicatively coupled to the ground contact, wherein the back shield is to reduce radio frequency interference (RFI) from the I/O interface; and a side shield disposed as a continuous protrusion surrounding a periphery at the interface between the plug and the receptacle.

10. An input/output (I/O) interface to couple a peripheral device to a computing device, comprising:

a receptacle of the I/O interface, wherein the receptacle is to receive a plug;

a ground contact of a circuit board;

a back shield communicatively coupled to the ground contact, and wherein the back shield is to reduce radio frequency interference (RFI) from the I/O interface; and a side shield disposed as a continuous protrusion surrounding a periphery at the interface between the plug and the receptacle.

11. The input/output (I/O) interface of claim 10, wherein the I/O interface comprises a first side that radiates relatively more RFI than a second side of the I/O interface, and wherein the side shield is disposed at the first side.

12. The input/output (I/O) interface of claim 9, wherein the side shield is configured to receive a protrusion of the plug to communicatively couple the plug to the receptacle.

13. The input/output (I/O) interface of claim 9, wherein the side shield is a protrusion of the receptacle to communicatively couple the plug to the receptacle.

14. The input/output (I/O) interface of claim 9, wherein the I/O interface comprises a first side that radiates relatively more RFI than a second side of the I/O interface, and wherein the side shield is disposed at the first side.

15. The input/output (I/O) interface of claim 9, wherein the back shield is communicatively coupled to the receptacle.

16. The input/output (I/O) interface of claim 10, wherein the side shield is a protrusion of the receptacle to communicatively couple the plug to the receptacle.

17. The input/output (I/O) interface of claim 10, wherein the back shield is communicatively coupled to the receptacle.

18. The input/output (I/O) interface of claim 10, wherein the side shield is configured to receive a protrusion of the plug to communicatively couple the plug to the receptacle.

* * * * *